US005085404A

United States Patent [19]

Thieleke et al.

[11] Patent Number: 5,085,404

[45] Date of Patent: Feb. 4, 1992

[54] STAPLE REMOVING DEVICE

[75] Inventors: Douglas L. Thieleke, Grimes; Douglas A. Callison, Des Moines, both of Iowa

[73] Assignee: D.L.T. Mfg. Corp., Johnston, Iowa

[21] Appl. No.: 393,260

[22] Filed: Aug. 14, 1989

[51] Int. Cl.[5] ..... B25C 11/00

[52] U.S. Cl. ..... 254/28

[58] Field of Search ..... 254/28, 18; 7/125, 165, 7/166

[56] References Cited

U.S. PATENT DOCUMENTS 3,311,346 3/1967 Almond ..... 254/28

4,784,370 11/1988 Strickland ..... 254/28

*Primary Examiner*—Robert C. Watson

*Attorney, Agent, or Firm*—Kinney & Lange

[57] ABSTRACT

A staple removing device including a pair of hinged, opposing jaws. Each jaw includes an anvil member that is movable into and out of contact engagement with the other anvil member upon relative movement of the jaws. In one embodiment, the anvil members are used to release a staple that has been partially removed by the jaws. In another embodiment, the anvil members engage the staple simultaneously with use of the jaws to open the staple so as to facilitate complete release of the staple.

4 Claims, 3 Drawing Sheets

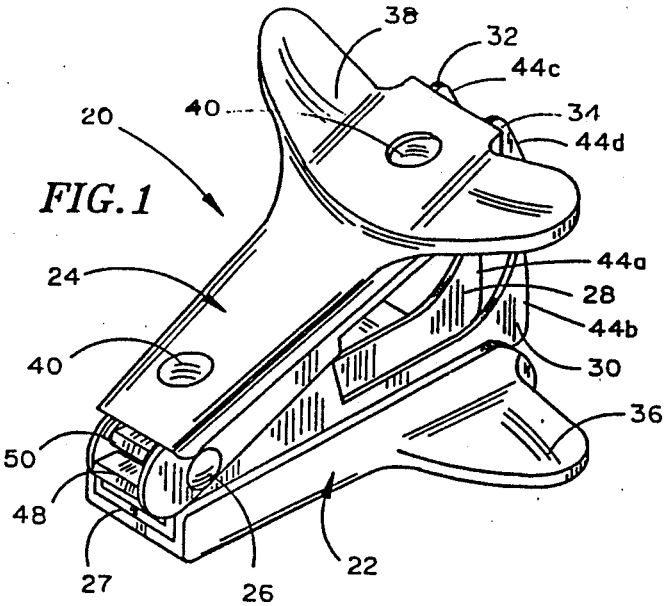
FIG. 1
FIG. 2A
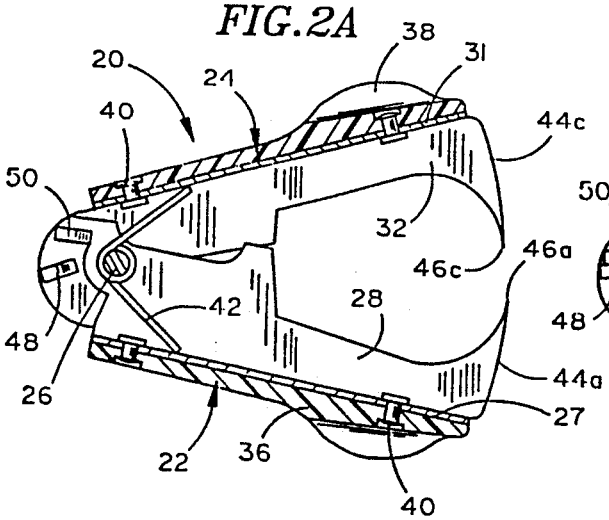
FIG. 2B
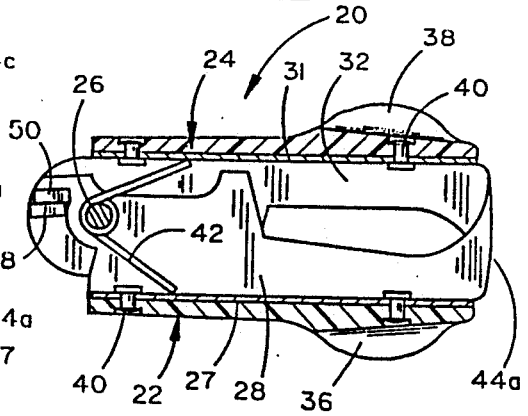
FIG. 3
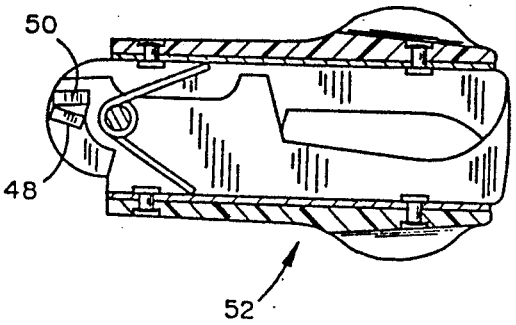
FIG. 4
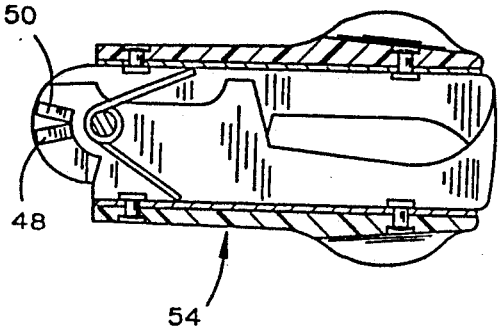

FIG. 5A
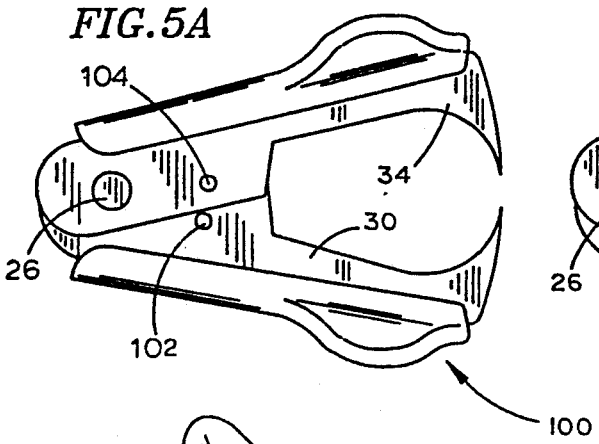
FIG. 5B
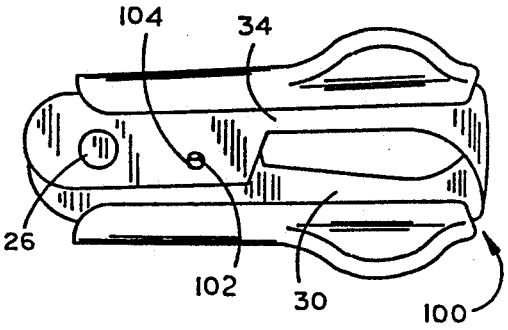
FIG. 6
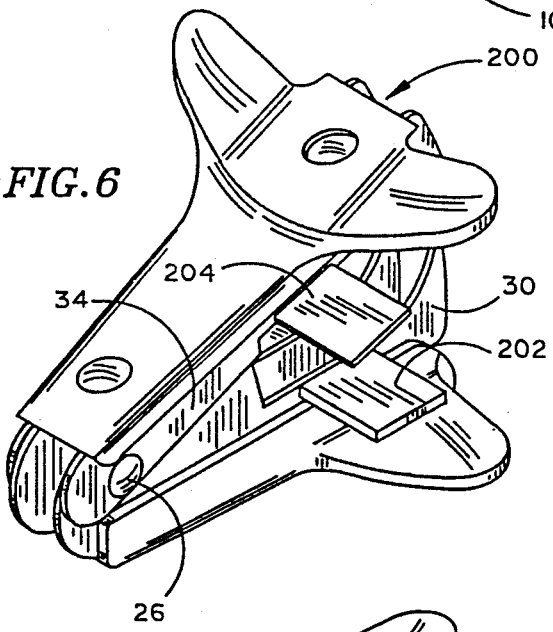
FIG. 7
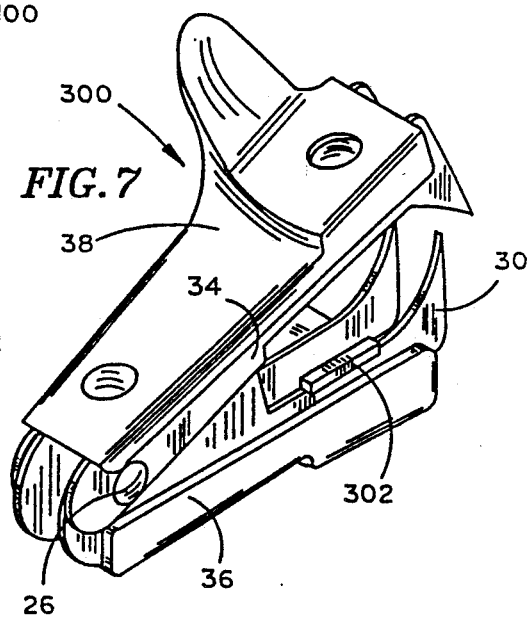
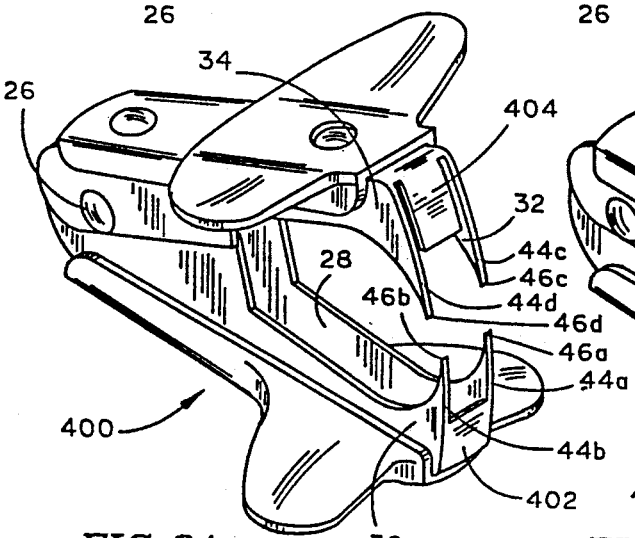
FIG. 8A
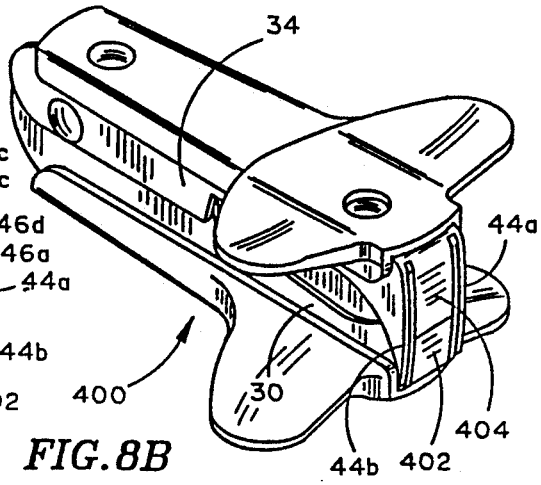
FIG. 8B FIG. 9
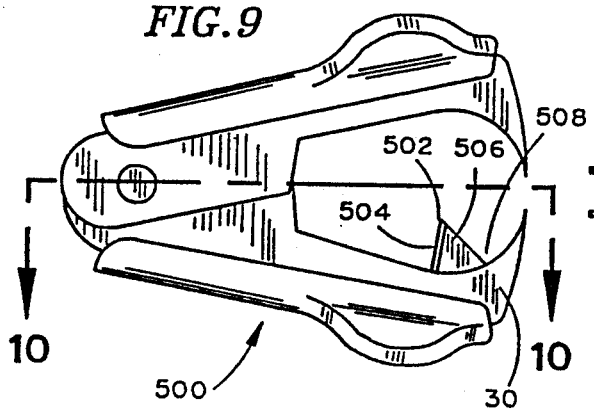
FIG. 10
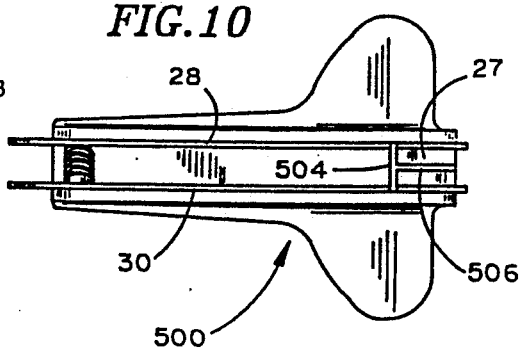
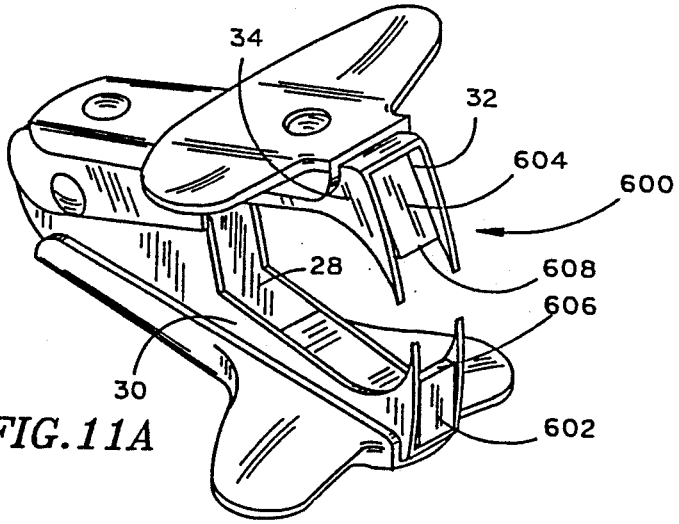
FIG. 11A
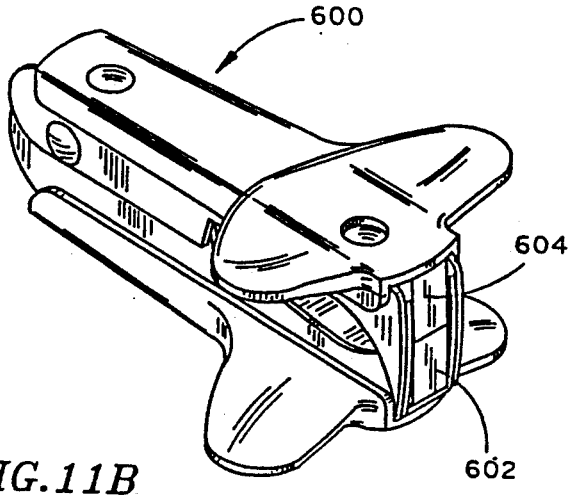
FIG. 11B

STAPLE REMOVING DEVICE

BACKGROUND OF THE INVENTION

The invention relates generally to staple removers and, more particularly, to devices for removing broken or partially removed staples.

The conventional staple remover is well-known. One example is described in U.S. Pat. No. 2,033,050. It acts by the closure of a pair of opposing jaw members that have had their terminal, pointed end portions inserted between the staple and the paper to which it had been applied. The jaws have a curved profile increasing in longitudinal dimension from their pointed end portions on the staple side and being substantially flat on the paper side. The staple is thus forced open and may be removed from the paper.

Not infrequently, the staple breaks upon being opened and during removal from the paper. If the staple breaks, only a portion will be removed from the paper and the other portion will remain attached to the paper. The conventional staple removers offer no effective means for the removal of a broken staple.

Staples may also not be completely released from the paper by the conventional staple remover. One leg of the staple may remain in the paper while the free leg slips out of the grasp of the conventional staple remover. Whether a broken portion of a staple remains in the paper or an unbroken staple is incompletely released from the paper, the usual procedure employed is to attempt to grasp the staple or staple portion with the fingers and attempt to twist and pull it free from the paper.

The present invention is an improved staple removing device that more securely grasps the staple during the opening and removal process to help prevent leaving a staple or staple portion of the paper. If a staple or staple portion remains in the paper, the present invention can be used to grasp securely the staple or staple portion for easy and complete removal.

SUMMARY OF THE INVENTION

The present invention consists of a staple remover for removing staples secured to a plurality of sheets of paper or other associated material which has been modified to improve the staple grasping performance of the remover, or to provide independent means for positively grasping a staple or staple portion remaining in the paper, or both.

In one embodiment of the invention, a pair of opposing anvil members are provided opposite the hinge of the staple remover from the opening jaws of the remover. The anvil members are spaced apart when the staple remover is open, but close in abutting engagement when the jaws are closed. The free end of a partially removed staple or staple portion is grasped between the anvil members and removed or released from the paper.

In a second embodiment, a perforation is made in the opening jaws of the staple remover at a point forward of the hinge. The perforations are not aligned when the jaws are open and move into and out of alignment as the jaws are closed. When the holes are aligned, the free end of a partially removed staple or staple portion is inserted therein. As the jaws are closed further, the staple or staple portion will be grasped by the edges of the holes and can be removed from the paper.

In another embodiment, one of a pair of transversely extended anvil members project from the side of each of the jaws. The anvil members close in abutting engagement when the jaws are closed. The free end of a partially removed staple or staple portion is grasped between the anvil members for easy removal from the paper.

In still another embodiment, one of a pair of opposing anvil members extend between the sides of the jaws of the staple remover along the edge thereof that is placed adjacent the paper. As the jaws are closed, the anvil members come into abutting engagement. The free end of a staple or staple portion is grasped between the anvil members for easy removal from the paper.

In a further embodiment, an abutment member is located centrally of one of the pairs of jaws of the staple remover. The abutment member extends toward the opposing jaws at an angle inclined oppositely to the curve of the associated jaw sections. As the jaws are closed, the abutment member provides a surface that is opposed to, but substantially parallel with the opposing jaw sections. The web section of a staple being removed will be grasped between the abutment member, the edges of the opposing jaw sections, and the edges of the associated jaw sections to improve the removal efficiency of the staple remover.

In still a further embodiment, one of a pair of block-shaped anvil members are positioned longitudinally between the side sections of each of the jaws of the staple remover. As the jaws are closed, the block-shaped anvil members are moved into abutting engagement to grasp the web section of a staple being removed.

BRIEF DESCRIPTION OF THE DRAWINGS

FIG. 1 is a perspective view of one embodiment of the present invention;

FIG. 2A is a cross sectional view of the staple removing device shown in FIG. 1 with the jaws in the open position therefor, and FIG. 2B is a cross sectional view of the staple removing device of FIG. 1 with the jaws in the closed position therefor;

FIG. 3 is a cross sectional view of a variation of the staple removing device shown in FIG. 1;

FIG. 4 is a cross sectional view of another variation of the staple removing device shown in FIG. 1;

FIGS. 5A and 5B are side elevational views of another embodiment of the staple removing device wherein a pair of staple-grasping perforations are shown unaligned in FIG. 5A and in substantial alignment in FIG. 5B;

FIGS. 6 is a perspective view of another embodiment of the invention having transversely extended anvil members for grasping a staple;

FIG. 7 is a perspective view of still another embodiment of the invention having supplementary anvil members for grasping a staple;

FIGS. 8A and 8B are perspective views of yet another embodiment of the invention having opposing anvil members extended at the proximal edges and substantially between the side sections of the opposing jaws;

FIG. 9 is a side elevational view of still another embodiment of the invention having an abutment member located between the side sections of one of the pair of opposing jaws;

FIG. 10 is a plan view taken along the line 10-10 of FIG. 9; and

FIGS. 11A and 11B are perspective views of yet another embodiment of the invention, in the open and closed positions therefor, respectively, having a pair of opposed block-shaped anvil members each of which is located between the side sections of one of the opposing jaws.

DETAILED DESCRIPTION OF PREFERRED EMBODIMENT

A. First Preferred Embodiment

Illustrated in FIG. 1 generally at 20 is a staple removing device that is one of the preferred embodiments of the present invention. The staple removing device 20 is a modified conventional staple remover, as are all of the embodiments that will be described herein. The conventional staple remover includes a pair of opposing jaws 22 and 24 that are hinged at 26 near the rearward or distal end portions thereof. The first jaw 22 includes a web section 27 (FIGS. 2A and 2B), and a pair of spaced-apart parallel side sections 28 and 30 that extend longitudinally and on either side of the jaw 24. Similarly, the second jaw 24 includes a web section 31 and a pair of spaced-apart, parallel side sections 32 and 34 that extend longitudinally and on either side of the second jaw 24. The spacing of the side sections 28 and 30 relative to the spacing of the side sections 32 and 34 is such that the side sections 28 and 30 are inside and closely adjacent to the side sections 32 and 34 to permit relative pivotal movement of the jaws 22 and 24 between an open position (FIGS. 1 and 2A) and a closed position (FIG. 2B).

Each of the jaws 22 and 24 also includes a finger hold shown at 36 and 38, respectively. The finger holds 36 and 38 extend beyond either side of the side sections 28–34 and curve away from the opposing jaw to provide a convenient grasping site for the fingers of a user of the device 20. The finger holds 36 and 38 are mounted to the web sections 27 and 31, respectively, by rivets 40 or other suitable means. A spring 42 received about the hinge 26 urges the jaws 22 and 24 to the open position therefor.

The side sections 28–34 have proximal edges 44*a–d* that are slightly curved outwardly relative to the hinge point 26 of the staple removing device 26. Each of the proximal edges 44*a–d* extend toward the corresponding opposing jaw and terminate in a point 46*a–d* for insertion beneath the web section of a staple to be removed from a plurality of sheets of paper or other associated material. The side sections 28–34 curve outwardly and rearwardly from the points 46*a–d* to a substantially straight section and then to an overlap section near the hinge 26. As the jaws of the conventional staple remover (and the device 20) are closed between a staple and the adjacent paper to which it is attached, the web portion of the staple will be forced rearwardly along the curved section of the side sections 28–34 while the paper (and leg portions of the staple thereunder) will be adjacent the proximal edges 44*a–d*. The staple will accordingly be opened and the further removal thereby facilitated.

The modification to a conventional staple remover of the device 20 includes a pair of opposed anvil members 48 and 50 mounted on the side sections 32–34 and 28–30, respectively, rearwardly of the hinge 26. In the open position of the device 20 (FIGS. 1 and 2A), the anvil members 48 and 50 are spaced apart. As the jaws 22 and 24 are closed, the anvil members 48 and 50 move into abutting engagement (FIG. 2B). To remove a staple or portion of a staple that has been opened by the device 20 but remains embedded in the paper, a free end or other portion of the staple or staple portion is inserted between the anvil members 48 and 50 in the open position thereof. The jaws 22 and 24 are then closed by the fingers of a user on the finger holds 36 and 38 to grasp the staple or portion thereof between the opposed anvil members 48 and 50. The staple or staple portion can then be easily and conveniently extracted or released from the paper.

Two variations of the device 20 are shown in FIGS. 3 and 4. The first variation, shown generally at 52 in FIG. 3, moves the anvil members 48 and 50 such that they are in abutting engagement in the closed position of variation 52 only at the outward edges thereof. The second variation, shown generally in FIG. 4 at 54, moves the anvil members 48 and 50 such that they are in abutting engagement in the closed position of variation 54 only along the inward opposing edges thereof. By providing a sharper, defined area for grasping of a staple or staple portion, the first and second variations 52 and 54 may be preferred in certain circumstances over the larger, substantially flat grasping surface of the device 20.

B. Second Preferred Embodiment

A second preferred embodiment of the present invention is a staple remover device indicated generally at 100 in FIGS. 5A and 5B The device 100 is identical in structure and function (except as described below) to the conventional staple remover described in the preceding sections. The conventional staple remover has been modified by a pair of perforations in the side portions 30 and 34 of the device 100, namely first perforation 102 and second perforation 104. The perforations 102 and 104 are located equidistant from and forward of the hinge 26 so that as the device 100 is moved between its open and closed positions, the perforations 102 and 104 will go into and out of alignment. In the illustrated embodiment, the perforations 102 and 104 are out of alignment when the device 100 is in its open position (FIG. 5A). As the device is moved to its closed position, the perforations will move into alignment and then substantially out of alignment again (FIG. 5B). The perforations 102 and 104 are of a size that, when aligned, a free end of a staple or staple portion can be inserted therein. If pressure is then exerted to further close the device 100, the staple will be grasped between opposing edges of the perforations 102 and 104. The device 100 is thus useful for removing a partially freed staple or staple portion from one or more sheets of paper.

C. Third Preferred Embodiment

In a third preferred embodiment, a staple removing device, illustrated generally at 200 in FIG. 6, includes a pair of transversely extended anvil members 202 and 204, one each of which is attached to the straight sections of the side sections 30 and 34. The extended anvil members 202 and 204 are spaced apart when the device 200 is in the open position thereof, but will be in abutting engagement when the device 200 is in the closed position thereof. The extended anvil members 202 and 204 can, accordingly, be used to grasp a staple or staple portion for easy removal thereof.

D. Fourth Preferred Embodiment

In a fourth preferred embodiment, illustrated generally at 300 in FIG. 7, the straight section of the side section 30 includes an abutment member 302 mounted on its inwardly facing edge. The abutment member 302 extends transversely of the side section 30 so as to come into contact engagement with the inward facing surface of the straight section of side section 34 when the device 300 is moved to its closed position. A staple or staple portion can, accordingly, be grasped between the abutment member 302 and the side section 34 for easy removal. Note that the transversely extended portions of the finger holds 36 and 38 on the side of the device 300 having the abutment member 302 have been removed to expose the abutment member 302 for easy access to a staple or staple portion.

E. Fifth Preferred Embodiment

In a fifth preferred embodiment, a staple removing device, illustrated generally at 400 in FIGS. 8A and 8B, includes a first anvil member 402 that spans side sections 28 and 30 along the proximal edges 44*a* and 44*b* thereof, extending approximately half way from the lower web section 27 to the points 46*a* and 46*b*. A second anvil member 404 extends from the upper web section 31 inwardly so as to be substantially flush or even with the proximal edges 44*c* and 44*d* of the side sections 32 and 34 and approximately half way to the points 46*c* and 46*d*. A gap separates both of the sides of the second anvil member 404 from the side sections 32 and 34. When the device 400 is moved to its closed position (FIG. 8B), the side sections 28 and 30 are received in the gap between the second anvil member 404 and the side sections 32 and 34. In the closed position of the device 400, the first and second anvil members 402 and 404 are in abutting engagement. The anvil members 402 and 404 can, accordingly, be used to grasp a staple or staple portion for easy removal from one or more sheets of paper.

Note that an efficient method of manufacturing can be used to yield the fifth preferred embodiment device 400. The side sections 28–34 are most likely formed by stamping and folding of a flat sheet of metal to form the jaw having a substantially U-shape in cross section. The first and second anvil members 402 and 404 can likewise be formed during a similar stamping and folding process.

F. Sixth Preferred Embodiment

In the sixth preferred embodiment, a staple removing device, illustrated generally at 500 in FIGS. 9 and 10, includes an abutment member 502 located between the side portions 28 and 30. The abutment member 502 includes a transverse portion 504 and a longitudinal portion 506. The transverse portion 504 is secured to the side sections 28 and 30 and the longitudinal portion 506 extends longitudinally along the center line between the two side sections 28 and 30 (FIG. 10). The longitudinal portion 506 angles forwardly from the inner edge of the transverse portion 504 to form a staple-receiving cradle 508 between the longitudinal portion 506 and the curved portion of the side sections 28 and 30. As the device 500 is closed to remove a staple, the web of the staple will be grasped or pinched in the area 508 between the longitudinal portion 506, the curved portions of the side sections 28 and 30, and the curved portions of the side sections 32 and 34. Thus, the abutment member 502 acts to facilitate positive grasping of the staple during the conventional opening and removal process or motion.

G. Seventh Preferred Embodiment

In a seventh preferred embodiment, a staple removing device, illustrated generally at 600 in FIGS. 11A and 11B, includes a pair of anvil members 602 and 604 located intermediate the side sections 28 and 30 and the side sections 32 and 34, respectively. The anvil members 602 and 604 have at their forward end portions opposing abutment surfaces 606 and 608 which are brought into abutting engagement when the device 600 is moved to its closed position (FIG. 11B). The portion of the anvil members 602 and 604 rearward of the abutment surfaces 606 and 608 follow the profile of the side sections 28–34 so that staples removed by the device can accumulate atop such side sections. The anvil members 602 and 604, accordingly, will facilitate positive grasping of the web of a staple being loosened and removed and can also be used to grasp a partially removed staple or staple portion anywhere along the mating surfaces 606 and 608.

We claim:

1. A staple removing device, including an upper jaw member having a first and second side sections and a lower jaw member having third and fourth side sections, the upper jaw member being pivotally connected to the lower jaw member, the device comprising:

a first plate member integral with the upper jaw member, the first plate member positioned between the first and second side sections;

a second plate member integral with the lower jaw member, the second plate member positioned between the third and fourth side sections movable to a contact position with the first plate member when the upper and lower jaw members are moved toward each other so that a staple is engageable between the first and second plate members; and wherein the first jaw member includes a first gap and a second gap, the first gap being located between the first plate member and the first side section, the second gap being located between the first plate member and the second side section such that the third side section is received within the first gap and the fourth side section is received within the second gap when the first and second plate members are in contact with each other.

2. The device of claim 1 wherein the first plate member has a thickness approximately equal to a thickness of the first and second side sections.

3. The device of claim 1 wherein the second plate member has a thickness approximately equal to a thickness of the third and fourth side sections.

4. A staple removing device, including an upper jaw member having first and second side sections and a lower jaw member having third and fourth side sections, the upper jaw member being pivotally connected to the lower jaw member, the device comprising:

a first plate member integral with the upper jaw member, the first plate member attached to the first and second side sections;

a second plate member integral with the lower jaw member, the second plate member attached to the third and fourth side sections movable to a contact position with the first plate member when the upper and lower jaw members are moved toward each other so that a staple is engageable between the first and second plate members; and wherein the first plate member has a first edge portion, the first plate member being substantially perpendicular to the first and second side sections, and the second plate member has a second edge portion, the second plate member being substantially perpendicular to the third and fourth side sections, whereby the first edge contacts the second edge when the upper and lower jaw members are moved together so that a staple is engaged.

* * * * *

UNITED STATES PATENT AND TRADEMARK OFFICE

CERTIFICATE OF CORRECTION

PATENT NO. : 5,085,404

DATED : February 4, 1992

INVENTOR(S) : Douglas L. Thieleke

It is certified that error appears in the above-identified patent and that said Letters Patent is hereby corrected as shown below:

On the title page of the Patent, delete Douglas A. Callison as an Inventor

Col. 6, Line 27, after "having", delete "a"

Signed and Sealed this

Fourth Day of May, 1993

*Attest:*

Michael K. Kirk

MICHAEL K. KIRK

*Attesting Officer*

*Acting Commissioner of Patents and Trademarks*